US008822855B2

(12) United States Patent
Chan et al.

(10) Patent No.: US 8,822,855 B2
(45) Date of Patent: Sep. 2, 2014

(54) CARD CONNECTOR

(75) Inventors: Ching-Jung Chan, New Taipei (TW); Ta-Chih Yu, New Taipei (TW)

(73) Assignee: Proconn Technology Co., Ltd., New Taipei (TW)

( * ) Notice: Subject to any disclaimer, the term of this patent is extended or adjusted under 35 U.S.C. 154(b) by 265 days.

(21) Appl. No.: 13/589,132

(22) Filed: Aug. 18, 2012

(65) Prior Publication Data

US 2014/0051297 A1 Feb. 20, 2014

(51) Int. Cl.
*H01R 33/96* (2006.01)

(52) U.S. Cl.
USPC ..... 200/51.09; 439/188; 439/607.34

(58) Field of Classification Search
USPC ..... 200/51.09, 51.1; 439/188, 607.33, 439/607.22, 607.24, 630
See application file for complete search history.

(56) References Cited

U.S. PATENT DOCUMENTS

| | | | | |
|---|---|---|---|---|
| 6,478,595 | B2 * | 11/2002 | Nishioka | 439/188 |
| 6,638,087 | B1 * | 10/2003 | Takada et al. | 439/188 |
| 6,719,577 | B2 * | 4/2004 | Nogami | 439/188 |
| 7,789,709 | B1 * | 9/2010 | He et al. | 439/630 |
| 8,708,742 | B2 * | 4/2014 | Chan et al. | 439/607.22 |
| 2004/0259404 | A1 * | 12/2004 | Chang | 439/188 |

* cited by examiner

*Primary Examiner* — Felix O Figueroa
(74) *Attorney, Agent, or Firm* — Lin & Associates IP, Inc.

(57) ABSTRACT

A card connector includes an insulating housing having two side walls of which an inside defines an inserting fillister, electrical terminals including a switch terminal which has a first contact arm and a first contact tail protruding from a free end of the first contact arm, and an upper shielding shell covered on the insulating housing and having two side plates of which one is die-cut to form a connecting slice inserted in the inserting fillister. A bottom of the connecting slice is bent inward to form a ground slice. The card connector utilizes the cooperation of a controlling switch of an electronic card and the first contact arm to control connection and disconnection between the first contact tail and the ground slice so as to further control a write procedure of the electronic card, wherein the controlling switch is movable between a closed position and an open position.

9 Claims, 4 Drawing Sheets

CARD CONNECTOR

BACKGROUND OF THE INVENTION

1. Field of the Invention

The present invention relates to a card connector, and more particularly to a card connector capable of controlling a write procedure of an electronic card inserted in the card connector.

2. The Related Art

Memory as a carrier of data storage, brings great of convenience for electronic and computer information industries. Especially as the signal, independent and temporary carrier of data storage, it can make up for the capacity of the main memory. The memory acting in a card tray is known as an electronic memory card. Accordingly, a card connector is often used for connecting the electronic cards with electronic products for realizing signal transmission between the electronic cards and the electronic products. And a requirement for the card connector is whether it can control the write procedure of the electronic card or not.

SUMMARY OF THE INVENTION

Accordingly, an object of the present invention is to provide a card connector adapted for receiving an electronic card therein. The electronic card has a controlling switch movable between a closed position and an open position for controlling a write procedure of the electronic card. The card connector includes an insulating housing, a plurality of electrical terminals disposed in the insulating housing and including a plurality of signal terminals and a switch terminal, and an upper shielding shell covered downward on the insulating housing.

The insulating housing has a bottom board, a pair of side walls protruding upward from two opposite sides of the bottom board, and a rear wall protruding upward from a rear end of the bottom board. A receiving room is surrounded among the side walls and the rear wall for receiving the electronic card therein. An inner side of one side wall defines an inserting fillister communicating with the receiving room and penetrating upward through a top of the side wall. The signal terminals project upward into the receiving room for electrically contacting with the electrical card. The switch terminal has a first fastening strip disposed in one side of the bottom board near to one side wall, a first soldering tail and a first contact arm extending from a rear end and a front end of the first fastening strip respectively. The first soldering tail projects rearward out of the rear wall. The first contact arm elastically projects upward into the receiving room for being pressed by the controlling switch of the electronic card or set free from the controlling switch. A free end of the first contact arm further protrudes horizontally to form a first contact tail located beside the inserting fillister. The upper shielding shell has a top plate and a pair of side plates extending downward from two opposite side edges of the top plate. A part of one side plate is die-cut to form a connecting slice inserted downward in the inserting fillister. A bottom edge of the connecting slice is bent inward to form a ground slice projecting into the receiving room. The first contact tail of the switch terminal electrically abuts under the ground slice of the upper shielding shell for disabling the write procedure of the electronic card when the controlling switch of the electronic card is at the closed position to set free the first contact arm. When the controlling switch of the electronic card is at the open position to press the first contact arm downward, the first contact tail of the switch terminal is separated from the ground slice to enable the write procedure of the electronic card.

As described above, when the electronic card is inserted in the receiving room of the card connector, the card connector utilizes the cooperation of the controlling switch of the electronic card and the first contact arm of the switch terminal to control the connection and disconnection between the first contact tail of the switch terminal and the ground slice of the upper shielding shell so as to further control the write procedure of the electronic card.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
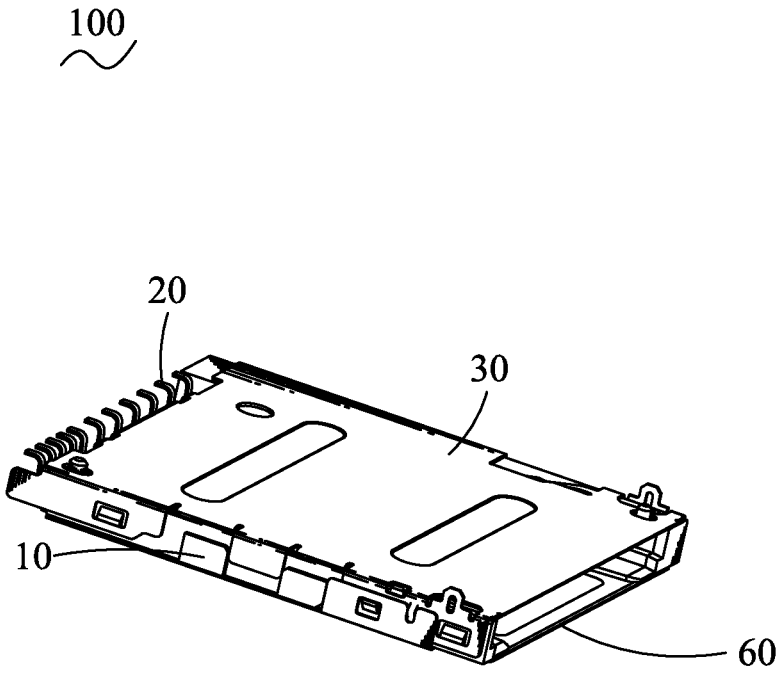
FIG. 1 is an assembled perspective view of a card connector according to an embodiment of the present invention.
Figure 2:
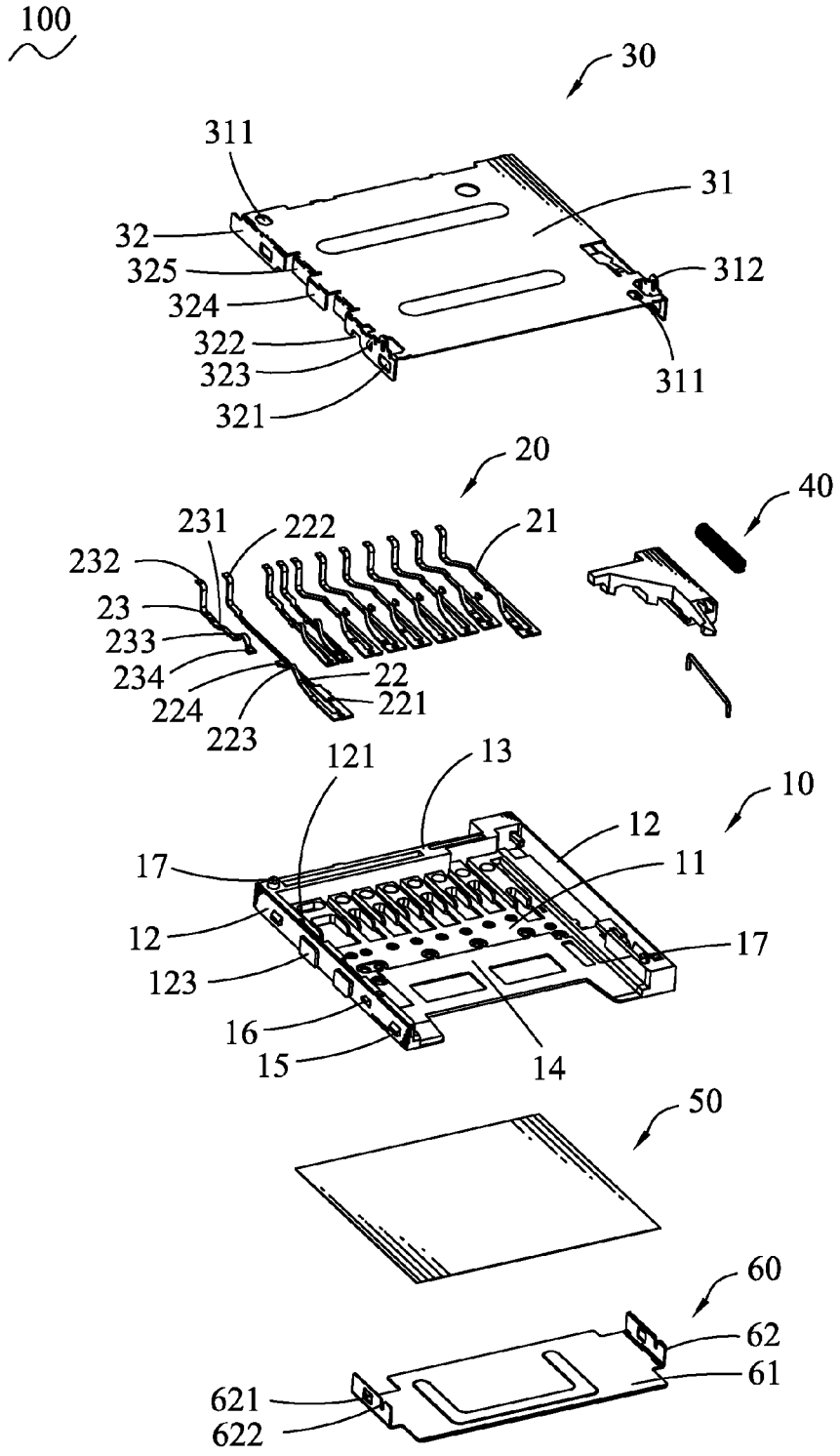
FIG. 2 is an exploded perspective view of the card connector of FIG. 1.
Figure 3:
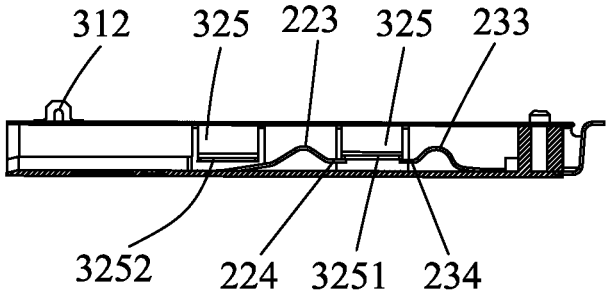
FIG. 3 is a cross-sectional view of the card connector of FIG. 1.
Figure 4:
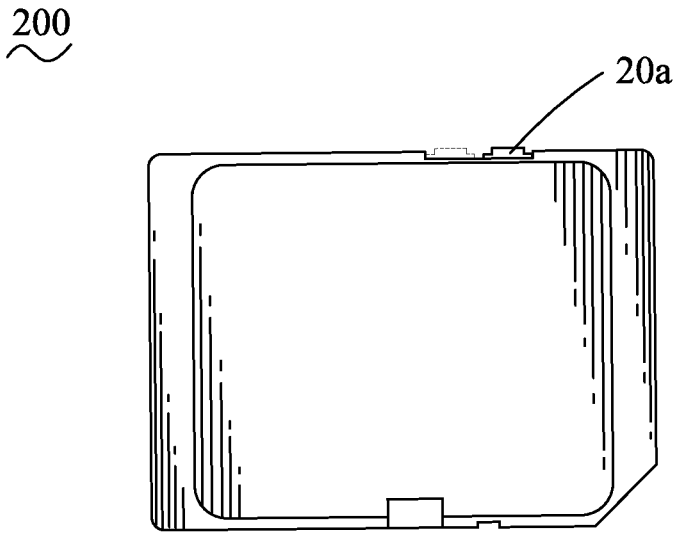
FIG. 4 is a perspective view of an electronic card adapted for being inserted in the card connector of FIG. 1.
Figure 5:
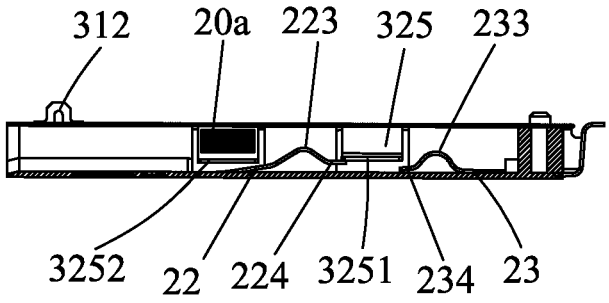
FIG. 5 is a view showing that the electronic card of FIG. 4 is inserted in the card connector of FIG. 3 and a controlling switch of the electronic card is at a closed position.
Figure 6:
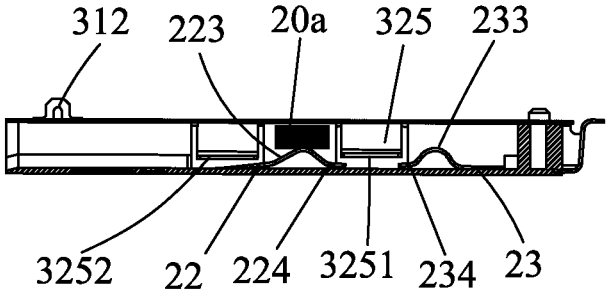
FIG. 6 is a view showing that the electronic card of FIG. 4 is inserted in the card connector of FIG. 3 and the controlling switch of the electronic card is at an open position.

With reference to FIG. 1, FIG. 2 and FIG. 4, a card connector 100 according to an embodiment of the present invention is adapted for receiving an electronic card 200 therein. The electronic card 200 has a controlling switch 20*a* movable between a closed position (dashed lines shown in FIG. 4) and an open position (real lines shown in FIG. 4) for controlling a write procedure of the electronic card 200. The card connector 100 includes an insulating housing 10, a plurality of electrical terminals 20, an upper shielding shell 30 and a lower shielding shell 60.

Referring to FIGS. 2-6, the insulating housing 10 has a bottom board 11, a pair of side walls 12 protruding upward from two opposite sides of the bottom board 11, and a rear wall 13 protruding upward from a rear end of the bottom board 11. A receiving room 14 is surrounded among the side walls 12 and the rear wall 13 for receiving the electronic card 200 therein. An inner side of one side wall 12 defines an inserting fillister 121 communicating with the receiving room 14 and further penetrating upward through a top of the side wall 12. The electrical terminals 20 are disposed in the insulating housing 10 and include a plurality of signal terminals 21 and a switch terminal 22. The signal terminals 21 project upward into the receiving room 14 for electrically contacting with the electrical card 200. The switch terminal 22 has a first fastening strip 221 disposed in one side of the bottom board 11 near to one side wall 12, a first soldering tail 222 and a first contact arm 223 extending from a rear end and a front end of the first fastening strip 221 respectively. The first soldering tail 222 projects rearward out of the rear wall 13. The first contact arm 223 elastically projects upward into the receiving room 14 for being pressed by the controlling switch 20*a* of the electronic card 200 or set free from the controlling switch 20*a*. A free end of the first contact arm 223 further protrudes horizontally to form a first contact tail 224 located beside the inserting fillister 121. The upper shielding shell 30 is covered downward on the insulating housing 10. The upper shielding shell 30 has a top plate 31 and a pair of side plates 32 extending downward from two opposite side edges of the top plate 31. A part of one side plate 32 is die-cut to form a connecting slice 325 inserted downward in the inserting fillister 121. A bottom edge of the connecting slice 325 is bent inward to form a ground slice 3251 projecting into the receiving room 14. The first contact tail 224 of the switch terminal 22 electrically abuts under the ground slice 3251 of the upper shielding shell 30 for disabling the write procedure of the electronic card 200 when the controlling switch 20*a* of the electronic card 200 is at the closed position to set free the first contact arm 223. When the controlling switch 20*a* of the electronic card 200 is at the open position to press the first contact arm 223 downward, the first contact tail 224 of the switch terminal 22 is separated from the ground slice 3251 to enable the write procedure of the electronic card 200.

Referring to FIG. 2, FIG. 3, FIG. 5 and FIG. 6, the inner side of one side wall 12 of the insulating housing 10 further defines an inserting fillister 121. Another part of one side plate 32 of the upper shielding shell 30 is die-cut to further form a connecting slice 325 inserted in the inserting fillister 121. A bottom edge of the connecting slice 325 is bent inward to form a guiding slice 3252 located in front of the ground slice 3251 and projecting into the receiving room 14 for positioning and guiding the insertion of the electronic card 200. Two sides of a front of the top plate 31 of the upper shielding shell 30 are die-cut upward to form a pair of ground tails 312.

Referring to FIG. 1 and FIG. 2 again, the lower shielding shell 60 is covered upward under the insulating housing 10. The lower shielding shell 60 has a bottom plate 61 and a pair of lateral plates 62 extending upward from two opposite side edges of the bottom plate 61. A front of a top edge of each lateral plate 62 is concaved downward to form a restricting gap 622. An outside of one side wall 12 of the insulating housing 10 protrudes outward to form a pair of stop blocks 123 spaced from each other along a front-to-rear direction. A substantial middle of one side plate 32 of the upper shielding shell 30 is die-cut to form a positioning slice 324 restricted between the stop blocks 123 of the side wall 12. A front of each side plate 32 of the upper shielding shell 30 is punched outward to form a vertical arched restricting portion 323 buckled in the restricting gap 622 of the lower shielding shell 60.

Two opposite outsides of the side walls 12 and a rear side of the rear wall 13 of the insulating housing 10 protrude outward to form a plurality of fastening blocks 15 of which each top face is slantwise downward. A rear edge of the top plate 31 of the upper shielding shell 30 extends downward to form a rear plate (not labeled). The side plates 32 and the rear plate define a plurality of fastening holes 321 for buckling the corresponding fastening blocks 15 therein. The two opposite outsides of the side walls 12 further protrude outward to form a pair of buckling blocks 16 of which each bottom face is slantwise upward. Bottom edges of the side plates 32 are concaved upward to form two receiving gaps 322 for locating the corresponding buckling blocks 16 therein. The lateral plates 62 of the lower shielding shell 60 abut against two opposite outsides of the side plates 32 of the upper shielding shell 30 and define a pair of buckling holes 621 for buckling the corresponding buckling blocks 16 therein. A top of the rear wall 13 near to one side wall 12 and a top of a front of the other side wall 12 protrude upward to form two positioning pillars 17. Two corners of the top plate 31 of the upper shielding shell 30 define a pair of positioning holes 311 for locating the positioning pillars 17 respectively.

Referring to FIGS. 2-6 again, the electrical terminals 20 further include a monitoring terminal 23 which has a second fastening strip 231 disposed in one side of the bottom board 11 of the insulating housing 10 between the first fastening strip 221 of the switch terminal 22 and one side wall 12, a second soldering tail 232 extending from a rear end of the second fastening strip 231 to project rearward out of the rear wall 13, and a second contact arm 233 extending forward from a front end of the second fastening strip 231 and arched upward to elastically project into the receiving room 14. A front end of the first fastening strip 221 protrudes sideward and then extends rearward with being arched upward to form the first contact arm 223. The first contact tail 224 is formed by a rear end of the first contact arm 223 protruding rearward. A front end of the second contact arm 233 further protrudes forward to form a second contact tail 234 located beside the corresponding inserting fillister 121 and apart aligned with the first contact tail 224 of the switch terminal 22 along a front-to-rear direction to electrically abut under the ground slice 3251 of the upper shielding shell 30. The second contact tail 234 is separated from the ground slice 3251 by virtue of being pressed downward by the electronic card 200 so as to monitor whether the electronic card 200 is inserted in position.

Referring to FIG. 2 again, the card connector 100 further includes an ejection device 40 and an insulating tape 50 of rectangular slice shape. The ejection device 40 is movably disposed in the other side wall 12 of the insulating housing 10 and further projects sideward into the receiving room 14. The insulating tape 50 is attached on a bottom surface of the bottom board 11 of the insulating housing 10 to close over bare parts of the electrical terminals 20 in the bottom board 11.

As described above, when the electronic card 200 is inserted in the receiving room 14 of the card connector 100, the card connector 100 utilizes the cooperation of the controlling switch 20*a* of the electronic card 200 and the first contact arm 223 of the switch terminal 22 to control the connection and disconnection between the first contact tail 224 of the switch terminal 22 and the ground slice 3251 of the upper shielding shell 30 Fso as to further control the write procedure of the electronic card 200.

What is claimed is:

1. A card connector adapted for receiving an electronic card therein, the electronic card having a controlling switch which is movable between a closed position and an open position for controlling a write procedure of the electronic card, the card connector comprising:

an insulating housing having a bottom board, a pair of side walls protruding upward from two opposite sides of the bottom board, and a rear wall protruding upward from a rear end of the bottom board, a receiving room being surrounded among the side walls and the rear wall for receiving the electronic card therein, an inner side of one side wall defining an inserting fillister communicating with the receiving room and further penetrating upward through a top of the side wall;

a plurality of electrical terminals disposed in the insulating housing and including a plurality of signal terminals and a switch terminal, the signal terminals projecting upward into the receiving room for electrically contacting with the electrical card, the switch terminal having a first fastening strip disposed in one side of the bottom board near to one side wall, a first soldering tail and a first contact arm extending from a rear end and a front end of the first fastening strip respectively, the first soldering tail projecting rearward out of the rear wall, the first contact arm elastically projecting upward into the receiving room for being pressed by the controlling switch of the electronic card or set free from the controlling switch, a free end of the first contact arm further protruding horizontally to form a first contact tail located beside the inserting fillister; and an upper shielding shell covered downward on the insulating housing, the upper shielding shell having a top plate and a pair of side plates extending downward from two opposite side edges of the top plate, a part of one side plate being die-cut to form a connecting slice inserted downward in the inserting fillister, a bottom edge of the connecting slice being bent inward to form a ground slice projecting into the receiving room, the first contact tail of the switch terminal electrically abutting under the ground slice of the upper shielding shell for disabling the write procedure of the electronic card when the controlling switch of the electronic card is at the closed position to set free the first contact arm, when the controlling switch of the electronic card is at the open position to press the first contact arm downward, the first contact tail of the switch terminal being separated from the ground slice to enable the write procedure of the electronic card.

2. The card connector as claimed in claim 1, wherein the inner side of one side wall of the insulating housing further defines an inserting fillister, another part of one side plate of the upper shielding shell is die-cut to further form a connecting slice inserted in the inserting fillister, a bottom edge of the connecting slice is bent inward to form a guiding slice located in front of the ground slice and projecting into the receiving room for positioning and guiding the insertion of the electronic card.

3. The card connector as claimed in claim 1, further comprising a lower shielding shell covered upward under the insulating housing, the lower shielding shell has a bottom plate and a pair of lateral plates extending upward from two opposite side edges of the bottom plate, a front of a top edge of each lateral plate is concaved downward to form a restricting gap, an outside of one side wall of the insulating housing protrudes outward to form a pair of stop blocks spaced from each other along a front-to-rear direction, a substantial middle of one side plate of the upper shielding shell is die-cut to form a positioning slice restricted between the stop blocks of the side wall, a front of each side plate of the upper shielding shell is punched outward to form a vertical arched restricting portion buckled in the restricting gap of the lower shielding shell.

4. The card connector as claimed in claim 3, wherein two opposite outsides of the side walls and a rear side of the rear wall of the insulating housing protrude outward to form a plurality of fastening blocks of which each top face is slantwise downward, a rear edge of the top plate of the upper shielding shell extends downward to form a rear plate, the side plates and the rear plate define a plurality of fastening holes for buckling the corresponding fastening blocks therein.

5. The card connector as claimed in claim 3, wherein two opposite outsides of the side walls further protrude outward to form a pair of buckling blocks of which each bottom face is slantwise upward, bottom edges of the side plates are concaved upward to form two receiving gaps for locating the corresponding buckling blocks therein, the lateral plates of the lower shielding shell abut against two opposite outsides of the side plates of the upper shielding shell and define a pair of buckling holes for buckling the corresponding buckling blocks therein.

6. The card connector as claimed in claim 3, wherein a top of the rear wall near to one side wall and a top of a front of the other side wall protrude upward to form two positioning pillars, two corners of the top plate of the upper shielding shell define a pair of positioning holes for locating the positioning pillars respectively.

7. The card connector as claimed in claim 1, wherein the electrical terminals further include a monitoring terminal which has a second fastening strip disposed in one side of the bottom board between the first fastening strip of the switch terminal and one side wall, a second soldering tail extending from a rear end of the second fastening strip to project rearward out of the rear wall, and a second contact arm extending forward from a front end of the second fastening strip and arched upward to elastically project into the receiving room, a front end of the first fastening strip protrudes sideward and then extends rearward with being arched upward to form the first contact arm, the first contact tail is formed by a rear end of the first contact arm protruding rearward, a front end of the second contact arm further protrudes forward to form a second contact tail located beside the inserting fillister and apart aligned with the first contact tail of the switch terminal along a front-to-rear direction to electrically abut under the ground slice of the upper shielding shell, the second contact tail is separated from the ground slice by virtue of being pressed downward by the electronic card so as to monitor whether the electronic card is inserted in position.

8. The card connector as claimed in claim 1, further comprising an insulating tape of rectangular slice shape which is attached on a bottom surface of the bottom board of the insulating housing to close over bare parts of the electrical terminals in the bottom board.

9. The card connector as claimed in claim 1, wherein two sides of a front of the top plate of the upper shielding shell are die-cut upward to form a pair of ground tails.

* * * * *